US010602282B2

(12) United States Patent
Van Der Werf

(10) Patent No.: US 10,602,282 B2
(45) Date of Patent: Mar. 24, 2020

(54) ADAPTIVE FEEDBACK GAIN CORRECTION

(75) Inventor: Erik Cornelis Diederik Van Der Werf, Eindhoven (NL)

(73) Assignee: GN Resound A/S, Ballerup (DK)

( * ) Notice: Subject to any disclaimer, the term of this patent is extended or adjusted under 35 U.S.C. 154(b) by 387 days.

(21) Appl. No.: 12/353,107

(22) Filed: Jan. 13, 2009

(65) Prior Publication Data

US 2010/0177917 A1 Jul. 15, 2010

(30) Foreign Application Priority Data

Dec. 23, 2008 (DK) ..... 2008 01839

(51) Int. Cl.
*H04R 25/00* (2006.01)

(52) U.S. Cl.
CPC ..... *H04R 25/453* (2013.01)

(58) Field of Classification Search
CPC .... H04R 25/505; H04R 3/02; H04R 2460/05; H04R 25/453
USPC ..... 381/23, 65–321
See application file for complete search history.

(56) References Cited

U.S. PATENT DOCUMENTS 5,259,033 A 11/1993 Goodings et al.
5,619,580 A 4/1997 Hansen
6,754,356 B1 * 6/2004 Luo et al. ..... 381/318
6,757,396 B1 * 6/2004 Allred ..... 381/106
6,876,751 B1 4/2005 Gao et al.
8,019,104 B2 9/2011 Klinkby et al.
8,116,489 B2 * 2/2012 Mejia et al. ..... 381/318
8,355,517 B1 1/2013 Fretz
2002/0057814 A1 * 5/2002 Kaulberg ..... H04R 25/453 381/312
2002/0076072 A1 * 6/2002 Cornelisse ..... 381/312
2002/0094100 A1 * 7/2002 Kates et al. ..... 381/318
2003/0053647 A1 * 3/2003 Kates ..... 381/318
2005/0094827 A1 * 5/2005 McDermott ..... H04R 25/453 381/98

(Continued)

FOREIGN PATENT DOCUMENTS

EP 1191814 3/2002
EP 1080606 1/2004

(Continued)

OTHER PUBLICATIONS

JP Notice of Reasons for Rejection dated Oct. 23, 2012, for JP Patent Application No. 2009-291277.

(Continued)

*Primary Examiner* — Marc Anthony Armand
(74) *Attorney, Agent, or Firm* — Vista IP Law Group, LLP

(57) ABSTRACT

A hearing aid includes a signal processor, a input transducer electrically connected to the signal processor, a receiver electrically connected to the signal processor, an adaptive feedback cancellation filter configured to suppress feedback from a signal path between the receiver and the input transducer, and a feedback gain correction unit configured for adjusting a gain parameter of the signal processor based at least in part on coefficients of the adaptive feedback cancellation filter. A method of adjusting a gain parameter of a signal processor of a hearing aid includes monitoring filter coefficients of a feedback cancellation filter of the hearing aid, and adjusting the gain parameter of the signal processor in dependence of the monitored filter coefficients.

37 Claims, 5 Drawing Sheets

(56) References Cited

U.S. PATENT DOCUMENTS

Figure 1:
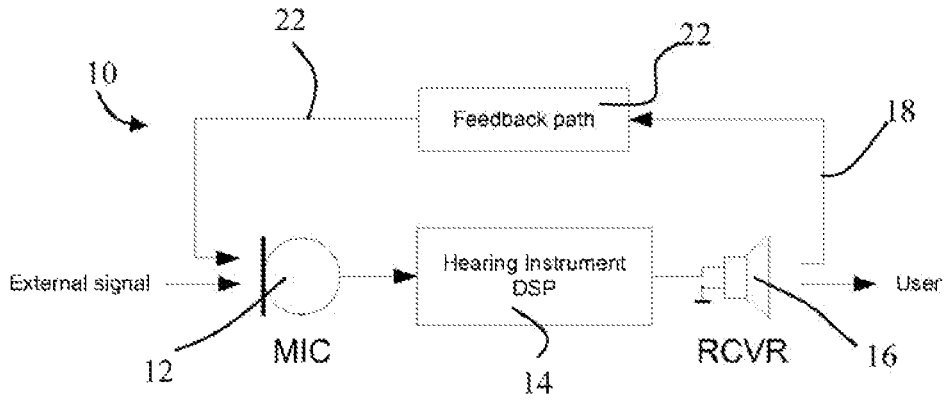
Fig. 1 PRIOR ART

2008/0273728 A1* 11/2008 Tjalfe Klinkby .... H04R 25/453
381/318

FOREIGN PATENT DOCUMENTS

| | | | |
|---|---|---|---|
| EP | 1439736 | | 7/2004 |
| EP | 1830602 | | 9/2007 |
| EP | 2 217 007 | | 2/2009 |
| EP | 2 136 575 | | 6/2009 |
| JP | 2008-523746 | A | 7/2008 |
| WO | 99/51059 | | 10/1999 |
| WO | WO03/015468 | | 2/2003 |
| WO | 2006/063624 | A1 | 6/2006 |
| WO | WO 2006/063624 | | 6/2006 |
| WO | 2008/065209 | | 6/2008 |

OTHER PUBLICATIONS

First Technical Examination and Search Report dated Feb. 5, 2014 for related Danish Patent Application No. PA 2013 70645, 5 pages.

Extended European Search Report for EP Patent Application No. 13191660.3 dated Mar. 27, 2014.

European Office Action dated Oct. 29, 2014 for related EP Patent Application No. 09 180 287.6, 5 pages.

International Search Report and Written Opinon dated Jan. 23, 2015 for related PCT Patent Application No. PCT/EP2014/073711.

Second Technical Examination—Intention to Grant dated Aug. 28, 2014 for related Danish Patent Application No. PA 2013 70645.

Office Action dated Jul. 1, 2009 for Danish Patent Application No. PA 2008 01839.

International Type Search Report dated Sep. 7, 2009 for DK 200801839.

Final Office Action dated Nov. 4, 2015 for U.S. Appl. No. 14/074,152.

Non-final Office Action dated Apr. 15, 2015 for U.S. Appl. No. 14/074,152.

European Communication pursuant to Article 94(3) EPC dated Jan. 28, 2016 for related EP Patent Application No. 13191660.3, 4 pages.

Non-final Office Action dated May 19, 2016 for related U.S. Appl. No. 14/074,152.

Notice of Allowance and Fee(s) due dated Mar. 3, 2017 for related U.S. Appl. No. 14/074,152.

* cited by examiner

ADAPTIVE FEEDBACK GAIN CORRECTION

This application claims priority to and the benefit of Danish Patent Application No. 2008 01839, filed on Dec. 23, 2008.

FIELD

The present application relates to a method for performing adaptive feedback cancelation in a hearing aid.

BACKGROUND

A hearing aid comprises an input transducer, an amplifier and a receiver unit. When sound is emitted from the speaker of the receiver unit some of the sound will return to the input transducer. This sound that returns back to the input transducer will then be added to the input transducer signal and amplified again. This process may thus be self-perpetuating and may even lead to whistling when the gain of the hearing aid is high. This whistling problem has been known for many years and in the standard literature on hearing aids it is commonly referred to as feedback, ringing, howling or oscillation.

Feedback thus limits the maximum stable gain that is achievable in a hearing aid. Some traditional approaches to avoid this feedback problem utilizes a feedback cancellation unit by which the feedback path is adaptively estimated and a feedback cancelling signal is generated and subtracted from the input signal to the hearing aid. Hereby as much as 10 dB additional gain is achievable before the onset of whistling.

However, even in very good adaptive digital feedback cancellation systems for hearing aids there will always be a residual error, e.g. the gain of the feedback cancellation signal will either be too large, in which case the feedback is overcompensated to such an extent that the hearing aid gain will not be adequate, or too small, in which case the gain of the signal will exceed the maximum stable gain limit and whistling may occur.

SUMMARY

One object of the embodiments is to provide a method where the feedback is more accurately estimated.

A first aspect of the embodiments relates to a hearing aid comprising a signal processor, an input transducer electrically connected to the signal processor, a receiver electrically connected to the signal processor, and an adaptive feedback cancellation filter configured to suppress feedback from a signal path from the receiver to the input transducer, the hearing aid further comprising: a feedback gain correction unit configured for adjusting a gain parameter of the sound processor, the adjustment being based on the coefficients of the adaptive feedback cancellation filter.

A second aspect of the embodiments relates to a method of adjusting a gain parameter of a signal processor of a hearing aid, the method comprising the steps of: monitoring the filter coefficients of a feedback cancellation filter of the hearing aid, and adjusting a gain parameter of the signal processor in dependence of the monitored filter coefficients.

In accordance with some embodiments, a hearing aid includes a signal processor, a input transducer electrically connected to the signal processor, a receiver electrically connected to the signal processor, an adaptive feedback cancellation filter configured to suppress feedback from a signal path between the receiver and the input transducer, and a feedback gain correction unit configured for adjusting a gain parameter of the signal processor based at least in part on coefficients of the adaptive feedback cancellation filter.

In accordance with other embodiments, a method of adjusting a gain parameter of a signal processor of a hearing aid includes monitoring filter coefficients of a feedback cancellation filter of the hearing aid, and adjusting the gain parameter of the signal processor in dependence of the monitored filter coefficients.

DESCRIPTION OF THE DRAWING FIGURES

Figure 2:
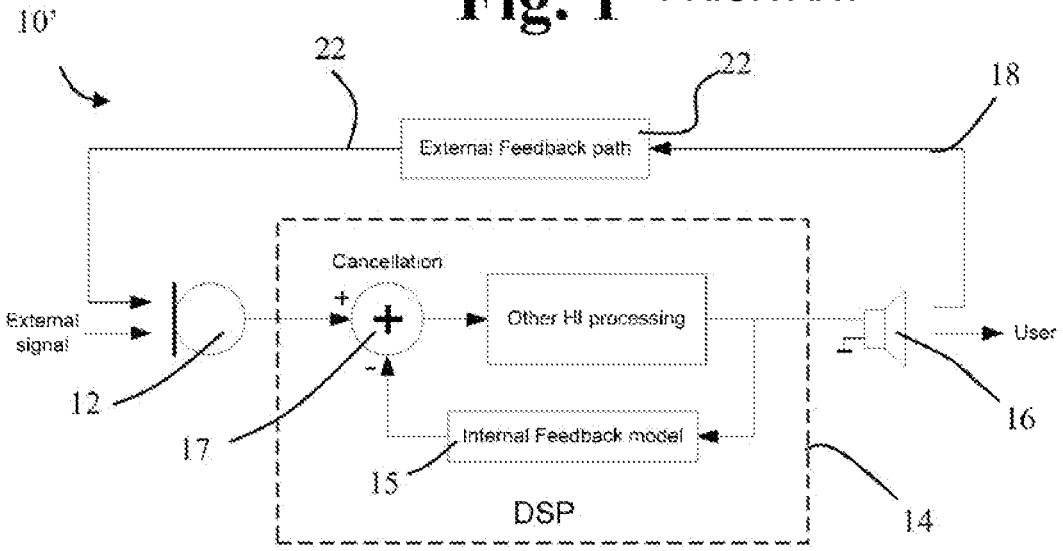
Fig. 2 PRIOR ART
Figure 3:
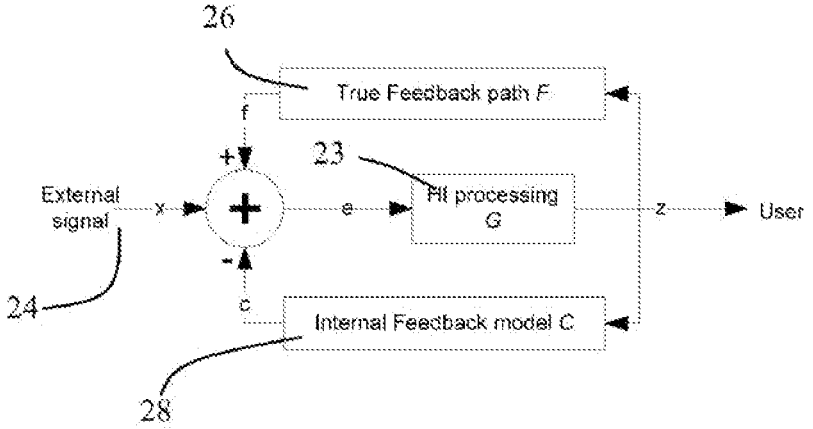
Figure 4:
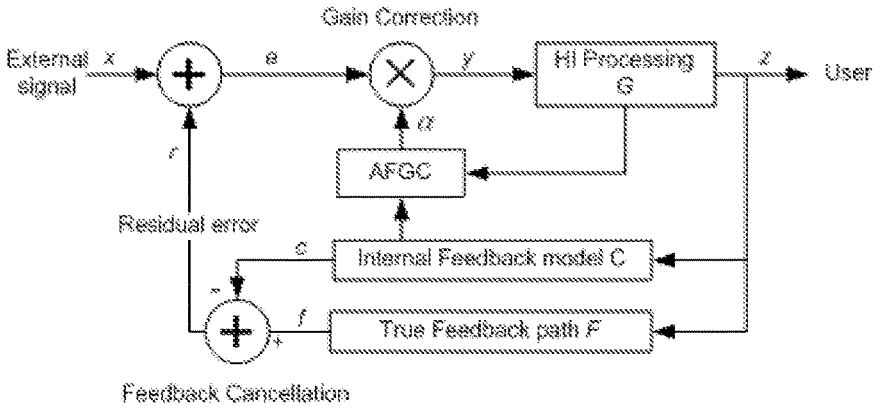
Figure 5:
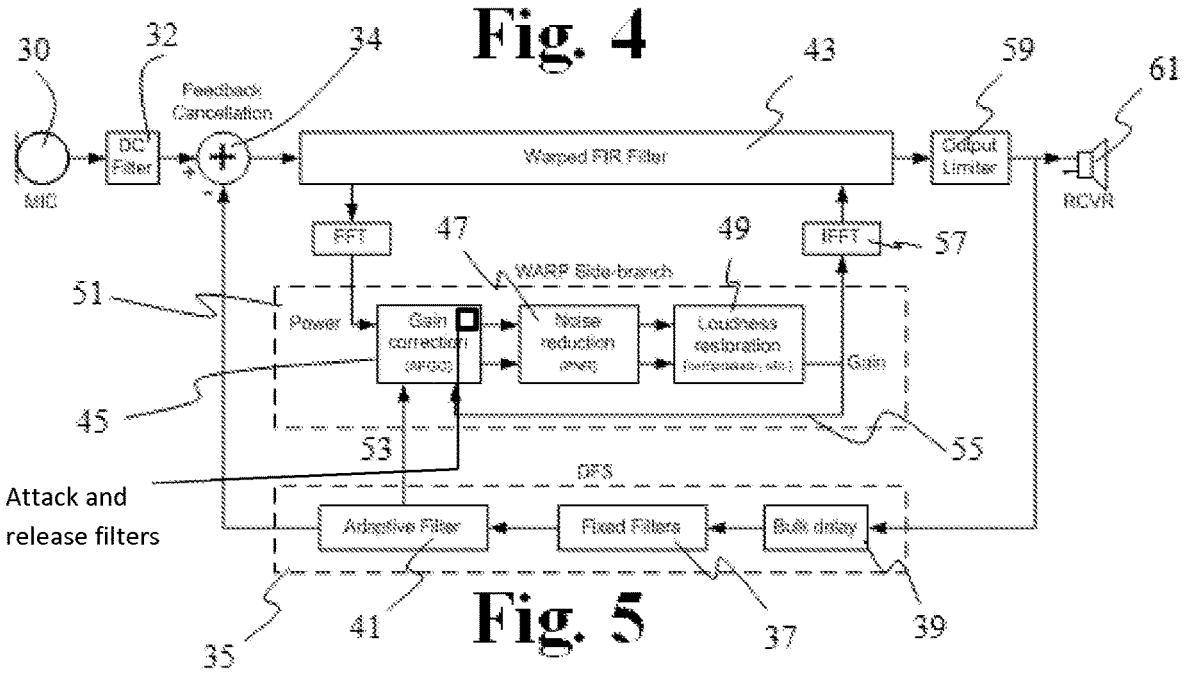
Figure 6:
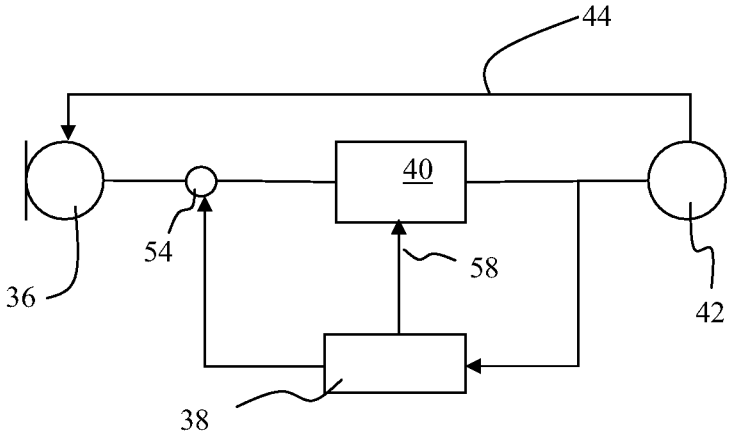
Figure 7:
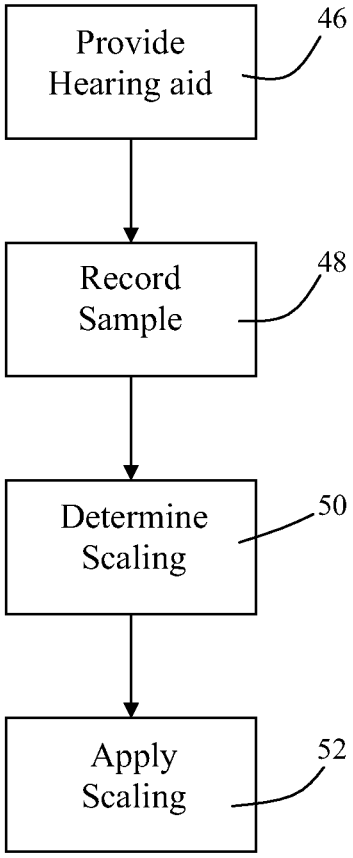
Figure 8:
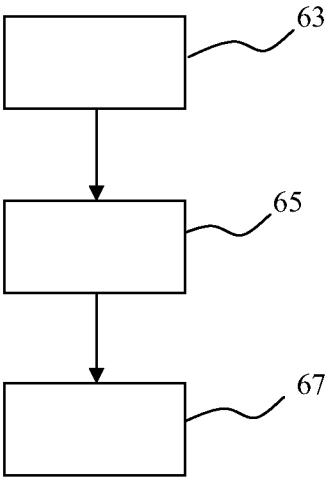

Some of the embodiments will be discussed in more detail with reference to the drawings in which:

FIG. 1 schematically illustrates a hearing aid,

FIG. 2 schematically illustrates a hearing aid with feedback cancellation,

FIG. 3 is a conceptual schematic illustration of feedback cancellation in a hearing aid, FIG. 4 schematically illustrates a conceptual model for feedback cancellation with gain correction, FIG. 5 schematically illustrates a hearing aid with adaptive feedback cancellation with gain correction, FIG. 6 is a schematic illustration of a hearing aid with a feedback cancellation unit, FIG. 7 shows a flow diagram of an embodiment of a method, and FIG. 8 shows a flow diagram of a preferred embodiment of a method.

DETAIL DESCRIPTION

Some of the embodiments will now be described more fully hereinafter with reference to the accompanying drawings. The claimed invention may, however, be embodied in different forms and should not be construed as limited to the embodiments set forth herein. Thus, the illustrated embodiments are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated. Like reference numerals refer to like elements throughout.

An embodiment of a hearing aid comprises an input transducer, an amplifier and a receiver unit. Generally it is understood that a transducer is a unit that is able to transform energy from one form to another form. In one embodiment the input transducer is a microphone, which is a unit that may transform an acoustical signal into an electrical signal. In another embodiment it is a tele-coil, which may transform the energy of a magnetic field into an electrical signal. In a preferred embodiment the input transducer comprises both a microphone and a tele-coil, and may also comprise a switching system by which it is possible to switch between the microphone or tele-coil input. The above mentioned elements are arranged so that it is inevitable that a part of the sound emitted from the receiver is received at the microphone. Also the electromagnetic field generated by the coils of the receiver may reach the tele-coil and add to the electromagnetic or magnetic field to be picked up by the tele-coil. This sound and electromagnetic field emitted by the receiver and received at the input transducer is called feedback. It is undesirable as this may lead to re-amplification of certain frequencies and become unpleasant for the wearer of the hearing aid. Therefore a feedback cancellation unit may be included in the hearing aid. The input transducer may be a microphone or the like. It is not only audible sound that may cause feedback; also vibrations in a housing may cause feedback and/or undesirable vibrations to be amplified.

Thus, as discussed above limitations in the performance of the feedback canceller may add a residual error in the estimated feedback cancellation signal. It is therefore an object to provide a system that improves the feedback cancellation, by the provision of a feedback cancellation system, wherein the residual error of the feedback cancellation system is accounted for.

The present embodiments provide Adaptive Feedback Gain Correction (AFGC) in order to reduce or eliminate the error of the internal feedback model. In order to achieve this, an estimate of the model error has to be provided. This estimate of the model error may be combined with prior knowledge of the maximum stable gain limit in each band to provide an adequate gain correction which maintains stability and may ideally restore normal loudness.

In a hearing aid acoustical signals are amplified to restore audibility for the hearing impaired user. A problem with such amplification is that a part of the amplified signal leaks back from the receiver to the input transducer, as depicted schematically in FIG. 1, and is then amplified again.

FIG. 1 schematically illustrates a hearing aid device 10.

The signal leaking back from the output to the input transducer is called feedback. At low amplification feedback only introduces some harmless coloring of the sound. However, when the hearing aid gain is large and the amplified signal feeding back from the receiver to the input transducer starts to exceed the level of the original signal we run the risk of creating an unstable loop which causes audible distortions and squealing.

To overcome the problem of feedback most digital hearing aids use a technique called feedback cancellation as depicted in FIG. 2.

To perform feedback cancellation in the illustrated hearing aid 10' the transfer function of the external feedback path 22 including the receiver 16, microphone 12 and other analog processing is modeled internally by the Digital Signal Processor 14. This model 15 of the feedback path is then used to create a phase-inverted signal which is added to the input signal in adder 17 in order to cancel the feedback signal, so that ideally only the external signal is amplified and presented to the user.

It is unlikely that the internal feedback model describes the external feedback path perfectly, and some fraction of the feedback signal is therefore likely to be amplified again. In the following paragraphs we will describe how the inevitable mismatch between the model and the true feedback path influences the effective amplification of the hearing instrument.

In the remainder of this document a simplified math notation will be used, where lower cases refer to time domain signals and upper cases refer to their z-transforms. FIG. 2 may be simplified by assuming linearity of all analog components and merging their contribution into one feedback path, which leads to FIG. 3.

FIG. 3 schematically illustrates the feedback path of a hearing aid. An external signal 24 generated by an input transducer is received and processed as illustrated by the hearing instrument signal processing block 23 in order to provide a hearing impairment corrected output signal to be presented to a user. The external signal 24 is added to the feedback signal that leaks back to the input transducer (not shown) via the feedback path 26. In the processing a part of the feedback is compensated or suppressed by the internal feedback model 28, e.g. a feedback compensation filter.

With reference to FIG. 3 the residual error may be defined as:

$$R=F-C$$

which represents the difference between the output signal of the internal feedback model 28 and the signal that leaks back to the input transducer via the true feedback path 26.

Using this residual error the transfer function of the model in FIG. 3 becomes $$\frac{Z}{X}=\frac{G}{1-GR},$$

which illustrates that the effective gain provided by the hearing aid approximates G, G being the gain of the hearing aid, when $|GR|<<1$.

In the following the output power of a hearing aid with feedback cancellation will be compared to that of an ideal hearing aid. The expected output power of an ideal hearing aid is given by $$E[Z_{ideal}^2]=|G|^2E[x^2]$$

The expected output power of the actual hearing aid is given by $$E[z^2]=E\left[\left|\frac{G}{1-GR}\right|^2\right]E[x^2]$$

By dividing these power estimates we may define the excessive gain $g_e$ that the hearing aid erroneously provides to the user due to the mismatch between F and C $$g_e^2=\frac{E[z^2]}{E[z_{ideal}^2]}=E\left[\frac{1}{|1-GR|^2}\right]$$

In order to put this definition to practical use it still needs a concrete solution for the expectation operator, which is possible by making some assumptions about the phase. However, since we in this example have no accurate phase information regarding R we have to make an assumption. If we pessimistically assume worst case behavior over all frequencies it is easy to see that the worst case excessive gain becomes $$g_{wce}=\frac{1}{1-|GR|}$$

Alternatively, to be more realistic, the expected excessive gain may be obtained by integrating over all angles in the complex plane (corresponding to an assumption that the phase is uniformly distributed) leading to $$g_{ee}=\frac{1}{\sqrt{1-|GR|^2}}$$

In principle we could also compute an optimistic estimate, by assuming that the phase always maximizes the denominator, but this usually requires very precise phase information in order to be of any practical use.

In the previous section we have shown how a mismatch between the true feedback path F and the internal feedback model C changes the effective gain delivered by the hearing aid. We will now consider a design where we attempt to correct for this excessive gain (assuming the expected case where the effective gain will exceed the desired gain).

A conceptual model for feedback cancellation with adaptive feedback gain correction is illustrated in FIG. 4.

In FIG. 4 the signals x is the external signal provided by the input transducer, r the residual error signal, and f is the true feedback signal. The signals that may be observed, i.e. determined by the hearing aid processor are e (a feedback compensated signal), c, y (an adjusted feedback compensated input), and z. As shown in FIG. 4, a (an adjustment factor or a gain parameter) is provided from AFGC. Also, as shown in FIG. 4, the internal feedback model C provides an input to the AFGC. Our goal is to find a gain factor or gain correction factor alpha a that satisfies $$E[x^2]==E[y^2]$$

so that (ideally) the signal power after gain correction corresponds to that of the external signal, and the output therefore reflects the desired amplification. For ease of notation (and hopefully understanding) in the following the expectation operator will be dropped and the variance will be used instead (we may do this because all signals are zero-mean).

If we assume the residual error and external signal to be uncorrelated, which is reasonable because the feedback canceller operates in such a way that it minimizes correlations, then the signal power at e is given by $$\sigma_e^2=\sigma_x^2+\sigma_r^2.$$

Applying a gain correction factor alpha then gives $$\sigma_y^2=\alpha^2\sigma_e^2,$$

which ideally matches the external signal power (see below).

Applying the hearing aid gain G and propagating through the residual error model gives $$\sigma_r^2=|R|^2|G|^2\rho_y^2$$

Combining all of the above gives the following estimate for the signal power at e $$\sigma_e^2=\sigma_x^2+\sigma_r^2=\sigma_x^2+\alpha^2|G|^2|R|^2\sigma_e^2$$

Rewriting terms gives the following estimate for the external signal power (notice the correspondence with our estimate for $g_{ee}$ presented above when alpha is set to one)

$$\sigma_x^2=(1-\alpha^2|G|^2|R|^2)\sigma_e^2$$

Equating this to the power after gain correction ($\sigma_y^2=\alpha^2\sigma_e^2$) gives $$(1-\alpha^2|G|^2|R|^2)\sigma_e^2=\alpha^2\sigma_e^2$$

Dividing out the variance and rewriting terms then gives the squared gain correction $$\alpha^2=\frac{1}{(1+|G|^2|R|^2)}$$

Extension of the above result to multiple bands is possible. For each band k we define a residual feedback gain $|R_k|$ and combine it with the desired gain $|G_k|$ as follows $$\alpha_k^2=\frac{1}{(1+|G_k|^2|R_k|^2)}$$

An embodiment of an adaptive feedback gain correction (AFGC) implementation will now be discussed in more detail below.

In this section we will present an embodiment of AFGC which provides gain correction in a number of frequency bands, preferably a number of warped bands, where it in a preferred embodiment is understood that by warping is meant an uneven frequency distribution, that preferably approximates the Bark frequency scale, using only one adaptive feature extracted from the internal feedback model. A schematic overview of the complete system is depicted in FIG. 5.

FIG. 5 schematically illustrates a hearing aid with one microphone 30. Things like A/D and D/A converters, buffer structures, optional additional channels, e.g., for beamforming, are omitted for simplicity.

The incoming signal received via the microphone is passed through a DC filter 32 which ensures that our signals are zero mean, this is convenient for calculating the statistics as discussed previously. In an embodiment the signal received via the microphone 30 may be passed to the adder 34.

Feedback cancellation may be applied by subtracting an estimated feedback signal c from the incoming signal s. The feedback signal estimate is calculated by the digital feedback suppression (DFS) subsystem 35 using a chain of fixed and adaptive filters operating on the (delayed) output signal of the hearing aid. In principle only one adaptive filter is necessary; the fixed filter(s) 37 and bulk delay 39 are only there for efficiency and performance. The fixed filter(s) 37 is typically an all-pole or general infinite impulse response (IIR) filter initialized from prior knowledge of the feedback path, for example obtained by measuring the feedback path in a fitting situation. The adaptive filter 41 is preferably a finite impulse response (FIR) filter, but in principle any other adaptive filter structure (lattice, adaptive IIR, etc.) may be used. In a preferred embodiment the adaptive filter 41 is an all zero filter. Also, although we in the illustrated embodiment use a broad-band implementation in the time domain, similar functionality may be implemented in, e.g., the frequency domain using an FFT or a multi-band structure.

The output signal of the DFS subsystem is transformed to the frequency domain. In this example is illustrated a side-branch structure where the analysis of the signal is done outside the signal path; the signal shaping is done using a time domain-filter constructed from the output of the side-branch. A warped side-branch system has advantages for high quality low-delay signal processing, but in principle any textbook FFT-system, a multi-rate filter bank, or a non-warped side-branch system may be used. Thus, although it is convenient to use frequency warping, it is not at all necessary in order to exercise the embodiments described herein.

The analysis of the signal starts by constructing a warped Fast Fourier Transform (FFT) which provides a signal power estimate for each warped frequency band. The wraping is obtained in the FIR filter 43 by replacing the unit delays in the FIR filter's 43 tapped delay line by all pass filters. Then in the warped side branch 51 a chain of so-called gain agents analyze these power estimates and adjust the gains and the corresponding powers in each band in a specific order. The order shown here is Adaptive Feedback Gain Correction (AFGC) 45, Noise reduction 47, and Loudness restoration 49. Other embodiments may use other combinations or sequences.

The first gain agent, AFGC 45, obtains input from the DFS subsystem 35, as indicated by arrow 53, which provides an estimate of the relative error of the feedback model. Also the output of the gain-chain as calculated in the previous iteration (representing the current gains as applied by the warped FIR filter) is inputted to the AFGC 45, as is illustrated by the arrow 55. The AFGC 45 then combines these inputs with its own feedback reference gain settings (the prior knowledge, e.g. obtained from initialization by measuring or estimating the feedback path during a fitting situation) to calculate an adequate gain correction, which is described in more detail later.

The second gain agent 47 shown here, providing noise reduction, is optional. Noise reduction is a comfort feature which is often used in modern hearing aids. Together the first two gain agents attempt to shape the signal in such a way that it is optimally presented for any listener, regardless of hearing loss, i.e., we attempt to restore the envelope of the original signal without unwanted noise or feedback.

Finally the remaining gain agent(s) 49 adjust loudness in order to compensate for the user-dependent hearing loss. The reader should notice here the difference between restoring the loudness of the original signal without feedback, as done by the AFGC unit 45, and restoring normal loudness perception for the hearing impaired listener. The latter typically requires significant amplification (which causes the need for a feedback suppression system) and is often combined with multi-band compression and limiting strategies (to provide more amplification to soft signals than to loud signals).

In principle the agents 45, 47 and 49 in the gain-chain may be re-ordered, e.g., by putting AFGC agent 45 at the end of the chain. However, it is presently preferred to use the illustrated ordering of first correcting the signal envelope before performing hearing loss dependent adjustments (which may be non-linear and sound pressure level-dependent).

When we reach the end of the gain-chain the output may be described as an output gain vector, which contains the merged contributions of each individual gain agent in each frequency band, is transformed back to the time domain using an Inverse Fast Fourier Transform (IFFT) 57 to be used as coefficient vector for the warped FIR filter. The gain vector is also propagated back to the AFGC unit 45 to be used in the next iteration as illustrated by arrow 55.

Finally, the signal that has passed through the warped FIR filter 43 is output limited in an output limiter 59 to ensure that (possibly unknown) receiver 61 and/or microphone 30 non-linearity does not influence the feedback path too much (otherwise the DFS system 35 may fail to model extreme signal levels adequately). In practice, explicit output limiting is optional because it may already be provided by a dynamic range compressor or even be available for free due to limits in the fixed point precision of the digital signal processor (DSP).

To calculate actual gain corrections we now need a model for the residual error. We assume that the residual feedback gain may be approximated by $$|R_k| = \beta |A_k|$$

where beta is an adaptive broad-band estimate of the fractional residual of the feedback canceller and $|A_k|$ provides a (constant) band-dependent scaling based on prior knowledge of the feedback path gain.

Using this estimate the squared gain correction for a band k becomes $$\alpha_k^2 = \frac{1}{(1 + \beta^2 |G_k|^2 |A_k|^2)}$$

which on a dB scale translates to $$\Delta g_k = -10 \log_{10}(1+\beta^2 |G_k|^2 |A_k|^2) = -10 \log_{10}(1+10^{0.1(\beta_{dB}+G_{kdB}+A_{kdB})})$$

where $\Delta g_k$ provides the target for the gain corrections in dB, i.e. a target for the adjustment of the gain parameter or gain adjustment parameter. Here the symbol $\Delta g_k$ is used instead of the linear form $\alpha_k$ because gains in the side branch are normally calculated in the log domain. In the following we will refer to $(\beta_{dB}+G_{kdB}+A_{kdB})$ as the uncorrected residual feedback gain $r_u$ (in dB). In practice, $r_u$ will be updated recursively from the actual hearing aid gains (as available at the end of the gain-chain) including the contribution of all gain agents, previous gain corrections, and the feedback reference gains.

Since the gains are updated in a closed loop some oscillations may occur. To reduce possibly disturbing gain fluctuations the gain corrections are smoothed using simple attack and release filters. Fast attacks are used to react quickly to sudden changes in the feedback path. Potential oscillations are dampened by slowly releasing the (reduced) gains.

In the current implementation the attack and release filters are applied in two stages. In the first stage we smooth a DFS feature β, which is used for all bands, with configurable attack and release rates. In the second stage, which is applied in each band, we combine an instantaneous attack with a slow fixed-step release.

Since computing an exp and a log for each band is rather expensive on a DSP approximations may be used instead.

Below is discussed an embodiment for calculating the feedback reference gains $A_k$.

The feedback reference gains $|A_k|$ may be estimated from knowledge of the feedback path which is obtained by the initialization of the feedback canceller, for example by measuring the impulse response of the feedback path during fitting of the hearing aid. The internal feedback model is a good starting point for finding the feedback reference gains. However, since the internal model may be inaccurate, it is useful to consider other potential feedback paths as well.

The so called DDFS modeler provides two maximum stable gain (MSG) curves, namely $MSG_{on}$ and $MSG_{off}$. The $MSG_{off}$ curve is the inverse of the feedback gain curve, as measured by the initialization procedure. The $MSG_{on}$ curve, also known as the error curve, is the inverse of the difference between the modeled and the measured feedback gain curves.

From the initialization we may derive the following three candidate feedback paths: (1) the internal path, (2) the external path, and (3) the difference between the internal and the external path. The internal path is simply the model fitted to the maximum length sequence (MLS) response obtained by an initialization procedure (in order to avoid standing waves the measurement of the impulse response of the feedback path is preferably done by using a MLS signal). The external path is defined by the raw impulse response obtained at initialization for which the magnitude response is identical to the (inverse) $MSG_{off}$ curve. The third path may be obtained from the $MSG_{on}$ curve. Normally the $MSG_{on}$ curve is significantly above the $MSG_{off}$ curve (because of the added stable gain), so to use it as a reference we may want to take this offset into account.

At this point we may also take into account the effect of the anti-aliasing and DC filters (unless already accounted for through some other calibration procedure).

Next the curves have to be transformed to the warped frequency domain, which may be done in two different ways. In both cases we first window with the magnitude response for each warp band, using a suitable windowing function. When windows are used the frequency bands are preferably overlapping in order to account for loss of signal features at band boundaries due to the attenuation done by the window function. Then we either take the maximum gain (the worst case frequency), or we merge the contribution of all bins using Parseval's theorem (summing the normalized squared values in the linear domain).

To be on the safe side we may also calculate all available transforms and then take the maximum in each band. This ensures that we have an upper bound estimate for both narrow and broad peaks and also takes into account potentially self-induced feedback due to poor modeling of the reference and fixed filter.

Below is discussed an example how the fractional residual error D may be estimated.

The DDFS feedback canceller stores prior knowledge of the feedback path in a reference vector for the adaptive FIR filter. It may be shown that at low gains (several dB below $MSG_{off}$) stability may be guaranteed by clamping the adaptive FIR filter coefficient vector w within a one-norm distance from its reference coefficient vector $w_{ref}$ (representing the zeros in the model obtained from the initialization). When applied to FIR filter coefficients the one-norm of the coefficient vector represents an upper bound on the amplification attainable by the filter for any input signal. Now instead of explicitly limiting the solution space of the feedback canceller we may also use the clamp estimate (the one-norm distance to the reference coefficients) in an implicit way by adjusting the gain and with that the margin before instability.

If we assume the reference vector to be the true feedback path and imagine the difference between the reference coefficients and the adaptive filter coefficients as a separate FIR filter, then the output power of this hypothetical filter provides an upper bound on the residual error. Of course in practice we may assume that the adaptive filter coefficients adapt away from the reference for a good reason, and that this does not lead to a one-to-one increase in the residual error. Consequently, we may assume that only a fraction of the deviation from the reference contributes to the residual error.

Since we know that feedback problems are more likely to occur in some frequencies than others it is possible to emphasize this in our estimate by pre-filtering the coefficient vectors. This pre-filtering may also help to avoid potential degradation of our estimate due to unrelated problems like dc-coefficient drift or sensitivity to speech signals.

Finally we may consider that due to limitations in our model and acoustical environment there is a lower bound on the residual error even when the distance to the reference becomes zero.

We now combine these ideas to formulate the following estimate for the fractional residual error $$\beta = \max\left(\beta_{min}, c\frac{\|h*(w-w_{ref})\|_1}{\beta_{norm}}\right)$$

where $\beta_{min}$ represents the minimal fractional residual error, h represents a filter for emphasizing certain frequencies, c is a tuning parameter, and $\beta_{norm}$ is a constant for normalization (which for a final implementation may also be included in c) calculated using the same metric $$\beta_{norm}=\|h*w_{ref}\|_1$$

Since the parameter $\beta_{min}$ is closely related to the static performance of the feedback canceller it may be linked to the headroom estimate provided by the DDFS modeler. The scaling parameter c is closely related to the dynamic performance of the feedback canceller and therefore has to be tuned by trial and error. A good choice for h appears to be the first order difference filter which removes DC, emphasizes the high frequencies and may be calculated without multiplications.

As mentioned above the present embodiments relate to a hearing aid comprising a signal processor, an input transducer electrically connected to the signal processor, a receiver electrically connected to the signal processor, and an adaptive feedback cancellation filter configured to suppress feedback from a signal path from the receiver to the input transducer, the hearing aid further comprising:

a feedback gain correction unit configured for adjusting a gain parameter of the signal processor, the adjustment being based on the coefficients of the adaptive feedback cancellation filter.

As mentioned above it is almost inevitable that some of the sound emitted by the receiver leaks back to the input transducer. This leak constitutes a feedback signal. Therefore there is a need to suppress or reduce the effect of the feedback signal in the hearing aid. It is contemplated that adjusting a gain parameter, (e.g. the gain) of the signal processor will provide an efficient cancellation or suppression of the feedback signal while at the same time providing optimum loudness for the user. It is understood that the gain parameter of the signal processor is a feed-forward gain of the signal processor, and not the gain of the feedback cancellation signal, the later being influenced by the filter coefficients of the feedback cancellation filter.

It is contemplated to be advantageous to calculate or determine an adjustment of the gain parameter of the signal processor by scaling of an input signal to the signal processor. Hereby a simple way of adjusting the gain parameter is achieved, because the gain of the input signal is scaled before it is subjected to the possibly nonlinear signal processing in the signal processor in order to provide a hearing impairment corrected signal. The input signal will thus have the optimal loudness before it is subjected to the hearing impairment specific processing by the signal processor, and hence the hearing impairment corrected will have the optimal loudness when it will be presented to the user.

In an embodiment the adjustment of the gain parameter may further be based on a set of reference coefficients. The reference coefficients could be established by measurements during a fitting situation and/or by estimation based on previous scaling.

In an embodiment the adjustment of the gain parameter may further be based on the deviation of the filter coefficients of the feedback cancellation filter from a reference set of filter coefficients. This deviation could be established as the numerical difference between the filter coefficients and the reference values or as a fraction of the numerical difference between the actual filter coefficients and the reference set of filter coefficients.

The coefficients of the adaptive feedback cancellation filter may be determined during the previous sample. New or adapted coefficients of the adaptive feedback cancellation filter may be determined for the current sample, and may be based on signal properties of the current sample.

In an embodiment the hearing aid may further comprise attack and release filters configured for smoothing process parameters in the gain correction unit. This is contemplated to allow a faster processing.

As also mentioned a second aspect relates to a method of adjusting a gain parameter of a signal processor of a hearing aid, the method may comprise the steps of monitoring the filter coefficients of a feedback cancellation filter of the hearing aid, and adjusting a gain parameter of the signal processor in dependence of the monitored filter coefficients.

Advantageously the monitored filter coefficients may originate from a previous sample, e.g. the immediately preceding sample.

In an embodiment the adjustment of the gain parameter of the signal processor may comprise a scaling of an input signal to the signal processor.

Advantageously the adjustment of the gain parameter of the signal processor may further be based on a set of reference filter coefficients.

Also the adjustment of the gain parameter may further be based on the deviation of the filter coefficients of the feedback cancellation filter from a reference set of filter coefficients.

In an embodiment the adjustment of the gain parameter of the signal processor may be determined band-wise in a plurality of frequency bands or determined in a broad band, and is performed band-wise in a plurality of frequency bands.

Alternatively the adjustment of the gain parameter of the signal processor may be determined band-wise in a plurality of frequency bands or determined in a broad band, and may be performed in a broad band.

In one embodiment the broad band is a frequency band that comprises the plurality of frequency bands, and in a preferred embodiment the plurality of frequency bands are overlapping. Preferably, the overlapping is configured such that the bands are consecutively ordered after center frequency and that one band overlaps the next band at the band boundaries.

Even more advantageously the feedback cancellation may be performed by subtracting an estimated feedback signal from the incoming signal. This is contemplated to suppress or reduce the feedback.

Still even more advantageous the signal processor may be configured to perform noise reduction and/or loudness restoration. This is contemplated to allow presentation of a comfortable sound signal to a user or wearer of the hearing aid.

FIG. 6 schematically illustrates a hearing aid comprising an input transducer 36 configured to receive an external sound signal. The input transducer 36 may comprise a microphone and a tele-coil. Alternatively the input transducer 36 may comprise a microphone. The hearing aid further comprises a feedback cancellation unit 38. The hearing aid still further comprises a signal processor 40. The hearing aid further comprises a receiver 42. The receiver 42 is configured to emit or transmit sound processed by the signal processor 40. Some of the sound transmitted or emitted from the receiver 42 may leak back to the input transducer 36, as illustrated by the arrow 44. Thereby the external sound signal may, as described above, be mixed with the sound leaking back from the receiver 42.

The illustrated configuration of the feedback cancellation unit 38 is a so called feedback path configuration generally known in the art, wherein the feedback cancellation unit produces a feedback signal that is subtracted from the input signal provided by the input transducer 36 in the adder 54. However it is understood that in an alternative embodiment the feedback cancellation unit 38 could be placed in a feed forward signal path.

The feedback cancellation unit 38 may comprise a memory unit to hold one or more previous samples to be used in feedback cancellation. Furthermore, as illustrated by the arrow 58 from the feedback cancellation unit 38 to the signal processor 40, information about the actual filter coefficients of the feedback cancellation filter are used to adjust a gain parameter, e.g. the gain itself, of the signal processor 40. Thus, it is seen that information about the actual filter coefficients of the feedback cancellation filter 38 is used to adjust the feed-forward gain, e.g. amplification, of the hearing aid. Specifically, the gain of the signal processor 40 may be adjusted in dependence of how much the actual filter coefficients of the feedback cancellation filter 38 deviates from a reference set of filter coefficients, wherein the reference set of filter coefficients for example may have been generated from a measurement of the feedback path during fitting of the hearing aid, for example in a dispenser's office.

FIG. 7 schematically illustrates a method comprising providing a hearing aid 46. The hearing aid comprising a sound processor, a input transducer electrically connected to the sound processor, a receiver electrically connected to the sound processor, and an adaptive feedback cancellation filter configured to suppress feedback from a signal path from the receiver to the input transducer and a feedback gain correction unit configured for scaling a gain adjustment parameter to the sound processor. The method comprising the steps of recording 48 a sample of a sound signal received via the input transducer. Determining 50 a set of scaling coefficients based on the sample and previous coefficients of the adaptive feedback cancellation filter. Applying 52 the set of scaling coefficients to the feedback gain correction unit and 54 processing the sample to the adaptive feedback cancellation filter.

FIG. 8 schematically illustrates a preferred embodiment of a method of adjusting a gain parameter of a hearing aid. The method comprises a step 63 of monitoring the filter coefficients of a feedback cancellation filter of the hearing aid, a step 65 of comparing the monitored filter coefficients to a reference set of filter coefficients, and a step 67 of adjusting the gain parameter of the hearing aid in dependence of said comparison. The step of comparing the filter coefficients to a set of reference filter coefficients may comprise the determination of a difference, e.g. the numerical difference between the actual filter coefficients and the reference set of filter coefficients. Further, advantageous embodiments of this method are set out in the dependent claims as defined below.

The features mentioned above may be combined in any advantageous ways.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

a signal processor;

an input transducer electrically connected to the signal processor; and a receiver electrically connected to the signal processor;

wherein the hearing aid comprises an adaptive filter configured to, via an adder, suppress feedback from a signal path between the receiver and the input transducer; and wherein the hearing aid comprises a feedback gain correction unit coupled to the adaptive filter, the feedback gain correction unit configured to adjust a gain parameter of the signal processor by performing a scaling operation on an input to the signal processor, and wherein the feedback gain correction unit is configured to perform the scaling operation before a hearing loss compensation is performed by the signal processor.

2. The hearing aid according to claim 1, wherein the feedback gain correction unit is configured for adjusting the gain parameter based at least in part on reference coefficients.

3. The hearing aid according to claim 1, wherein the feedback gain correction unit is configured for adjusting the gain parameter based at least in part on a deviation of coefficients of the adaptive filter from reference coefficients.

4. The hearing aid according to claim 2, wherein the reference coefficients are based on measurements in a fitting situation and/or an estimation that is based on a previous scaling.

5. The hearing aid according to claim 1, further comprising attack and release filters configured for smoothing the gain parameter, wherein the smoothing of the gain parameter is different from the adjustment of the gain parameter.

6. A method performed by a hearing aid, the hearing aid having a transducer and a hearing loss processing unit, comprising:

monitoring filter coefficients of a feedback cancellation filter of the hearing aid, an output of the feedback cancellation filter being subtracted from a signal obtained using the transducer to produce an input to the hearing loss processing unit; and adjusting the input to obtain an adjusted signal by performing a scaling operation on the input to the hearing loss processing unit;

wherein the act of adjusting is performed before the hearing loss processing unit performs a hearing loss compensation; and wherein the scaling operation is performed by a unit that is coupled to an adaptive filter.

7. The method according to claim 6, wherein the act of adjusting the input is performed based at least in part on a set of reference coefficients.

8. The method according to claim 6, wherein the act of adjusting the input is performed based at least in part on a deviation of the monitored filter coefficients of the feedback cancellation filter from reference coefficients.

9. The method according to claim 6, wherein the act of adjusting the input is performed band-wise in a plurality of frequency bands.

10. The method according to claim 6, wherein the act of adjusting the input is performed band-wise.

11. The method according to claim 6, further comprising performing a noise reduction, a loudness restoration, or both, on the adjusted signal using the hearing loss processing unit.

12. The method according to claim 6, wherein the act of adjusting the input is performed base at least in part on at least one gain parameter of the hearing loss processing unit.

13. The method according to claim 8, wherein the act of adjusting the input is performed in a warped frequency band.

14. The hearing aid of claim 1, wherein the adaptive filter is coupled between the adder and the receiver, and wherein an output of the adaptive filter is coupled to an input of the adder.

15. The hearing aid of claim 14, wherein the adaptive filter is coupled indirectly to the receiver.

16. The hearing aid of claim 14, wherein the output of the adaptive filter is coupled directly to the input of the adder.

17. The hearing aid according to claim 1, wherein the gain parameter comprises a feed-forward gain.

18. The method according to claim 6, wherein the adjusted signal is based on a feed-forward gain.

19. The method according to claim 6, wherein the input comprises a feedback compensated input.

20. The method according to claim 6, wherein the adjusted signal comprises an adjusted feedback compensated signal.

21. The method according to claim 6, wherein the adjusted signal comprises a gain-adjusted signal.

22. A hearing aid comprising:

a transducer for providing a transducer output;

a processing unit connected to the transducer;

a receiver connected to the processing unit; and a feedback cancellation filter;

wherein the processing unit is configured to perform a hearing loss compensation after an input to the processing unit is adjusted by a scaling operation performed on the input, wherein the input comprises a signal, the signal being based on the transducer output from the transducer and an output from the feedback cancellation filter.

23. The hearing aid according to claim 22, wherein the hearing aid is configured to adjust the signal based on a feed-forward gain.

24. The hearing aid according to claim 22, wherein the hearing aid is configured to change a gain parameter in the processing unit.

25. The hearing aid according to claim 24, wherein the hearing aid is configured to change the gain parameter based at least in part on filter coefficients.

26. The hearing aid according to claim 22, wherein the filter coefficients are based on measurements in a fitting situation and/or an estimation that is based on a previous scaling.

27. A method performed by a hearing aid, the hearing aid having a transducer and a feedback cancellation filter, the method comprising:

obtaining a transducer output from the transducer;

obtaining an output from the feedback cancellation filter;

producing a signal based on the transducer output and the output from the feedback cancellation filter; and adjusting the signal to obtain an adjusted signal, wherein the signal comprises an input to a processing unit of the hearing aid;

wherein the act of adjusting is performed before application of a hearing loss compensation, and wherein the act of adjusting comprises performing a scaling operation on the input to the processing unit of the hearing aid.

28. The method according to claim 27, wherein the adjusted signal is based on a feed-forward gain.

29. The method according to claim 27, wherein the signal comprises a feedback compensated signal.

30. The method according to claim 27, wherein the adjusted signal comprises an adjusted feedback compensated signal.

31. The method according to claim 27, wherein the adjusted signal comprises a gain-adjusted signal.

32. The method of claim 6, wherein the scaling operation on the input to the hearing loss processing unit is performed to determine an adjustment of a gain parameter.

33. The hearing aid of claim 22, wherein the hearing aid is configured to perform the scaling operation on the input to determine an adjustment of a gain parameter.

34. The method of claim 27, wherein the scaling operation is performed on the input to the processing unit to determine an adjustment of a gain parameter.

35. The hearing aid of claim 1, wherein the feedback gain correction unit is a part of a warped side branch.

36. The hearing aid of claim 35, wherein the warped side branch comprises a plurality of gain agents, and wherein the feedback gain correction unit is one of the gain agents.

37. The method of claim 6, wherein the hearing aid comprises a warped side branch with a plurality of gain agents, and wherein the unit is one of the gain agents.

* * * * *